US005367873A

United States Patent [19]

Barcza et al.

[11] Patent Number: 5,367,873

[45] Date of Patent: Nov. 29, 1994

[54] ONE-PIECE FLAMEHOLDER

[75] Inventors: W. Kevin Barcza, Stuart; Raymond J. Bruchez, Jr., North Palm Beach, both of Fla.

[73] Assignee: United Technologies Corporation, West Palm Beach, Fla.

[21] Appl. No.: 9,357

[22] Filed: Jan. 26, 1993

Related U.S. Application Data

[63] Continuation of Ser. No. 719,402, Jun. 24, 1991, abandoned.

[51] Int. Cl.[5] ..... F02K 3/10

[52] U.S. Cl. ..... 60/261; 60/739; 60/749

[58] Field of Search ..... 60/261, 739, 749

[56] References Cited

U.S. PATENT DOCUMENTS

| | | | |
|---|---|---|---|
| 3,056,261 | 10/1962 | Krabacher et al. | 60/739 |
| 4,629,397 | 12/1986 | Schweitzer | 60/267 |
| 4,765,136 | 8/1988 | Clements et al. | 60/749 |
| 4,815,283 | 3/1989 | Eldredge et al. | 60/261 |
| 4,942,732 | 7/1990 | Priceman | 60/261 |

OTHER PUBLICATIONS

*Mechanical Engineering Design*, Third Edition, Joseph Shigley, McGraw-Hill, 1977, pp. 664–667.

*Primary Examiner*—Richard A. Bertsch
*Assistant Examiner*—Howard R. Richman

[57] ABSTRACT

An improved flameholder for a thrust augmentation combustor includes a toroidal pilot gutter and inner and outer radial gutters, all having U-shaped cross-section and formed from a single piece of metal. The one-piece formation enables design improvements and variations which were not possible in the multiple piece construction of the prior art.

12 Claims, 6 Drawing Sheets

ONE-PIECE FLAMEHOLDER

This application is a continuation of application Ser. No. 07/719,402, filed on Jun. 24, 1991, now abandoned.

BACKGROUND OF THE INVENTION

This invention relates to a flameholder for use in a thrust augmentor in a high performance jet aircraft engine. In particular, the flameholder of the present invention is designed and formed in a single piece of metal.

FIG. 1 is a modified cross-sectional diagram of the thrust augmentor section of a high performance jet engine, usually used in military aircraft. It should be noted that the figure is a modified cross section in that the figure shows only structures which adjoin the central cross-sectional plane, and does not illustrate structures which would normally be viewed beyond that plane. The modified cross-section is used in FIG. 1 and other cross-sectional figures in this application for simplicity of illustration.

The thrust augmentation combustion chamber 10, or augmentor chamber, which is illustrated in FIG. 1 is aft of the engine turbine 12 and surrounds the engine tail cone 22. The augmentation chamber 10 is enclosed by an augmentation duct 14 which is typically a cylindrical structure that contains the augmentor. The augmentor duct 14 serves as a pressure vessel, confining the pressures and directing the flow into the nozzle 25. Within the augmentor duct 14 is arranged an augmentation liner 16 which is a shield that provides thermal protection to the augmentor duct 14 and also acts as an acoustical damper. The augmentation liner 16 extends from the aft end of the turbine to the exhaust nozzle 25. The spacing of the augmentation liner 16 relative to the augmentor duct 14 provides a separate flow of cool fan stream air along the duct inner surface. This air is picked up by the leading edge side of the augmentation liner 16. The rear sheet-metal section of the augmentor duct 14 is extended aft of the liner to obtain a controlled cooling air gap behind the liner for a greater distance. Fuel is supplied to the augmentor by spray rings 18 which are circular in configuration and provide fuel to air entering the augmentor chamber 10. A thrust augmentor flameholder 24, also of circular design and an igniter 20 are arranged behind the spray rings 18 to create turbulence for mixing the fuel injected by the spray rings 18 with the air entering the augmentor chamber and to provide a specific location for combustion which is ignited by the igniter 20.

FIGS. 2 and 3 illustrate a known construction technique for a thrust augmentor flameholder 24. The FIG. 2 view is an axial view of the flameholder 24 from the air inlet end of the engine. FIG. 3 is a modified cross-section taken along the lines illustrated in FIG. 2. The known flameholder 24 includes a pilot gutter, or pilot burner ring 26 which is toroidal in configuration and comprises a U-shaped cross-section member with a circular configuration around the engine axis. Radial inner and outer gutters are formed on sub-assemblies 28 and 30 as shown in FIG. 3, wherein, typically, outer radial gutter 32 is joined to a saddle member 38 by weld 42 and inner radial gutter 36 is joined to saddle member 38 by weld 40. The sub-assembly 30 is then rivetted to the pilot gutter 26 at seam 44 to create with sub-assemblies 28 at other locations as shown in FIG. 2 the flameholder assembly 24 shown in FIG. 2. The flameholder 24 propagates combustion of the fuel entering from the spray rings 18. In particular, the fuel injected by the spray rings 18 impinges on the upstream side of the flameholder 24, that is, from the left side as shown in the view of FIG. 1. The atomized fuel flows around the pilot gutter 26 of the flameholder 24 and is directed to the eddy behind the pilot gutter 26 and carried to the interior of the duct where the igniter 20 produces the ignition of the pilot fuel-air mixture. The flame propagates around the annular pilot burner ring and into the inner and outer radial gutters.

It is an object of the present invention to provide an improved flameholder design characterized by substantially one piece construction, that can provide reduced manufacturing cost and increased durability and performance.

SUMMARY OF THE INVENTION

In accordance with the invention there is provided an improved flameholder for a thrust augmentation combustor which includes a toroidal pilot gutter having a U-shaped cross-section and a plurality of inner and outer radial gutters also of U-shaped cross-section and projecting from the pilot gutter. The pilot gutter and the radial gutters are formed of a single piece of metal which may be either formed sheet metal or a cast metal which is appropriately molded to form the gutters and in addition to form rounded corners at the intersections of the pilot gutter and the radial gutters.

In an illustrative embodiment of the invention, made possible by the novel one piece construction, there are provided a greater number of outer radial gutters than inner radial gutters. Both the inner and outer radial gutters can be arranged at equal or unequal angular spacing around the pilot gutter. The inner radial gutters are preferably alternating long and short inner radial gutters. In the illustrative embodiment there are 24 outer radial gutters and 16 inner radial gutters.

For a better understanding of the present invention together with other and further objects, reference is made to the following description, taken in conjunction with the accompanying drawings, and its scope will be pointed out in the appended claims.

DESCRIPTION OF THE PREFERRED EMBODIMENT

Figure 4:
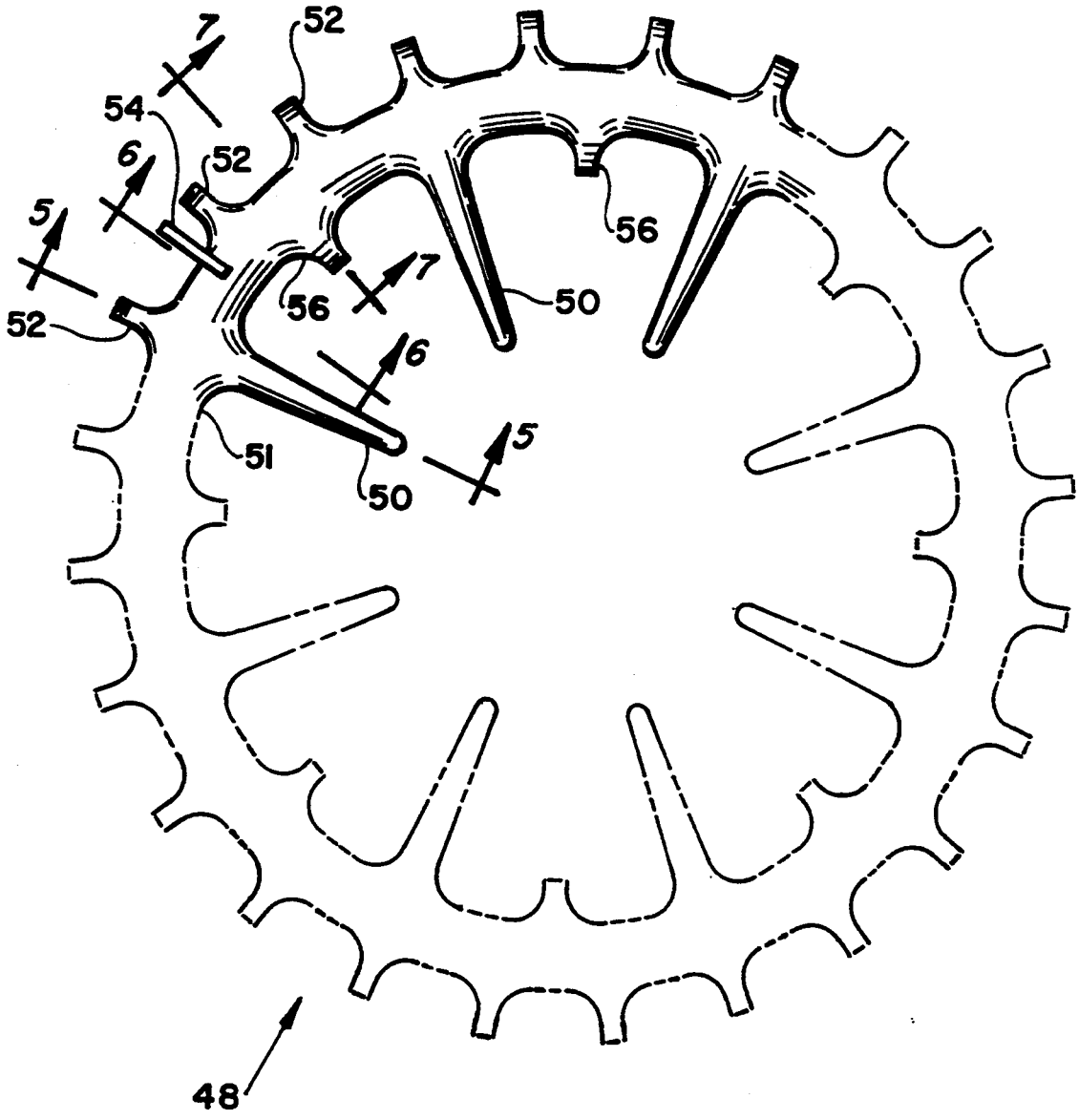
FIG. 4 is an axial view of a flameholder according to the present invention.
Figure 5:
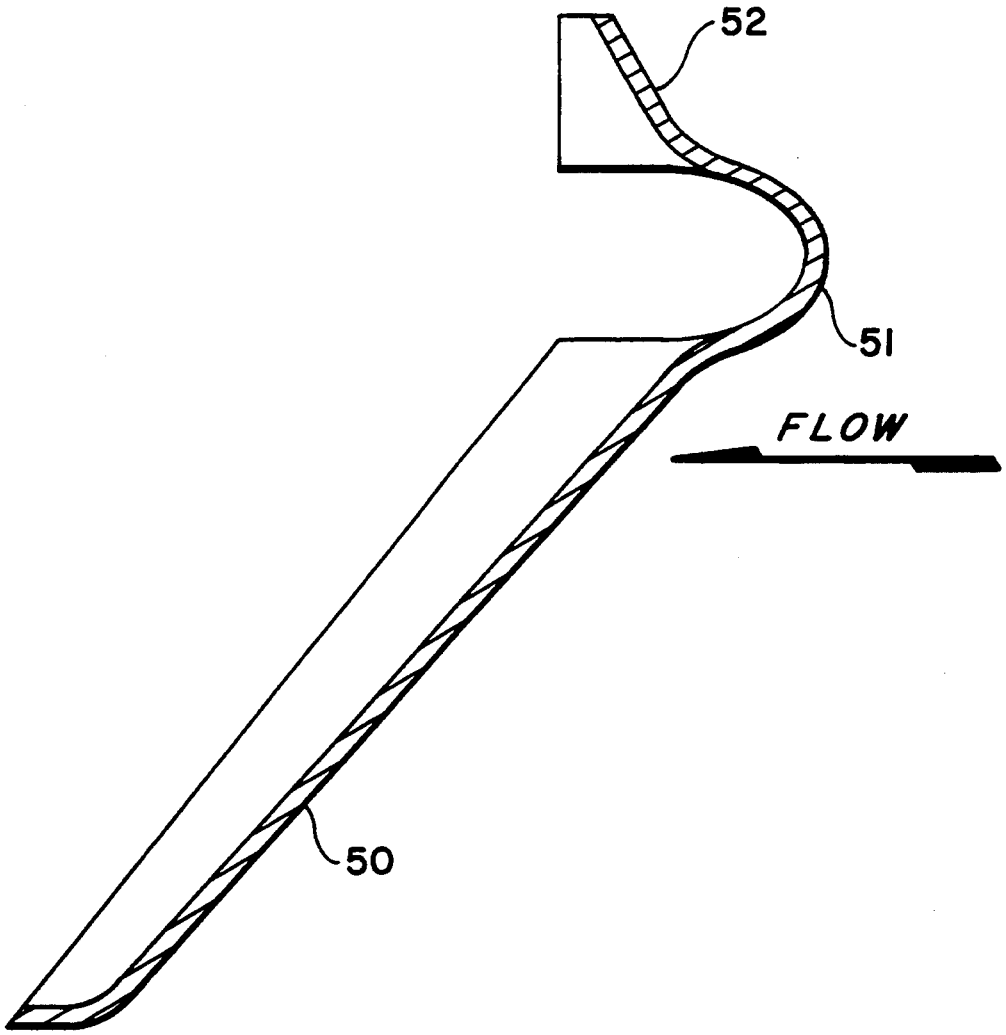
FIG. 5 is a modified cross-sectional view of the FIG. 4 flameholder illustrating the construction of the radial gutters.
Figure 6:
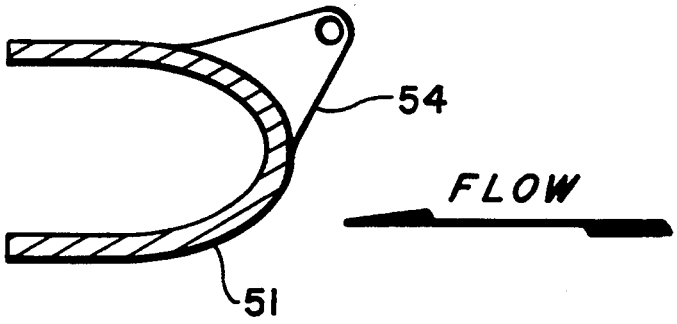
FIG. 6 is a modified cross-sectional view of the FIG. 4 flameholder showing the pilot gutter.
Figure 7:
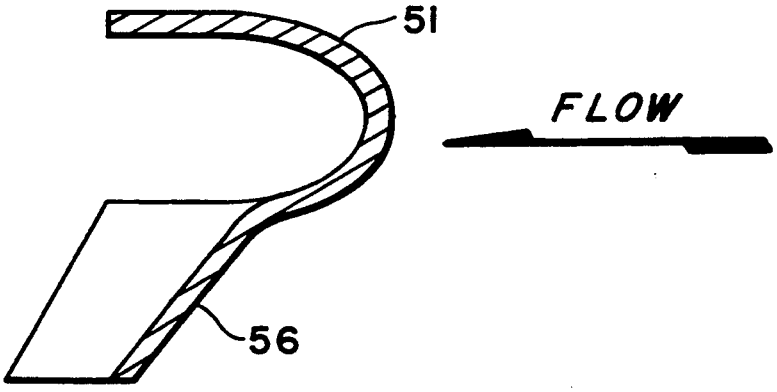
FIG. 7 is a modified cross-sectional view of the FIG. 4 flameholder showing the construction of one of the inner radial gutters.

FIG. 4 is an axial view from the engine intake side of a preferred embodiment of a flameholder 48 according to the present invention. Flameholder 48 is fabricated of a single piece of metal, such as sheet or cast Haynes 230 nickel alloy, to which one or more mounting flanges 54 have been formed or attached, such as by welding.

Figure 1:
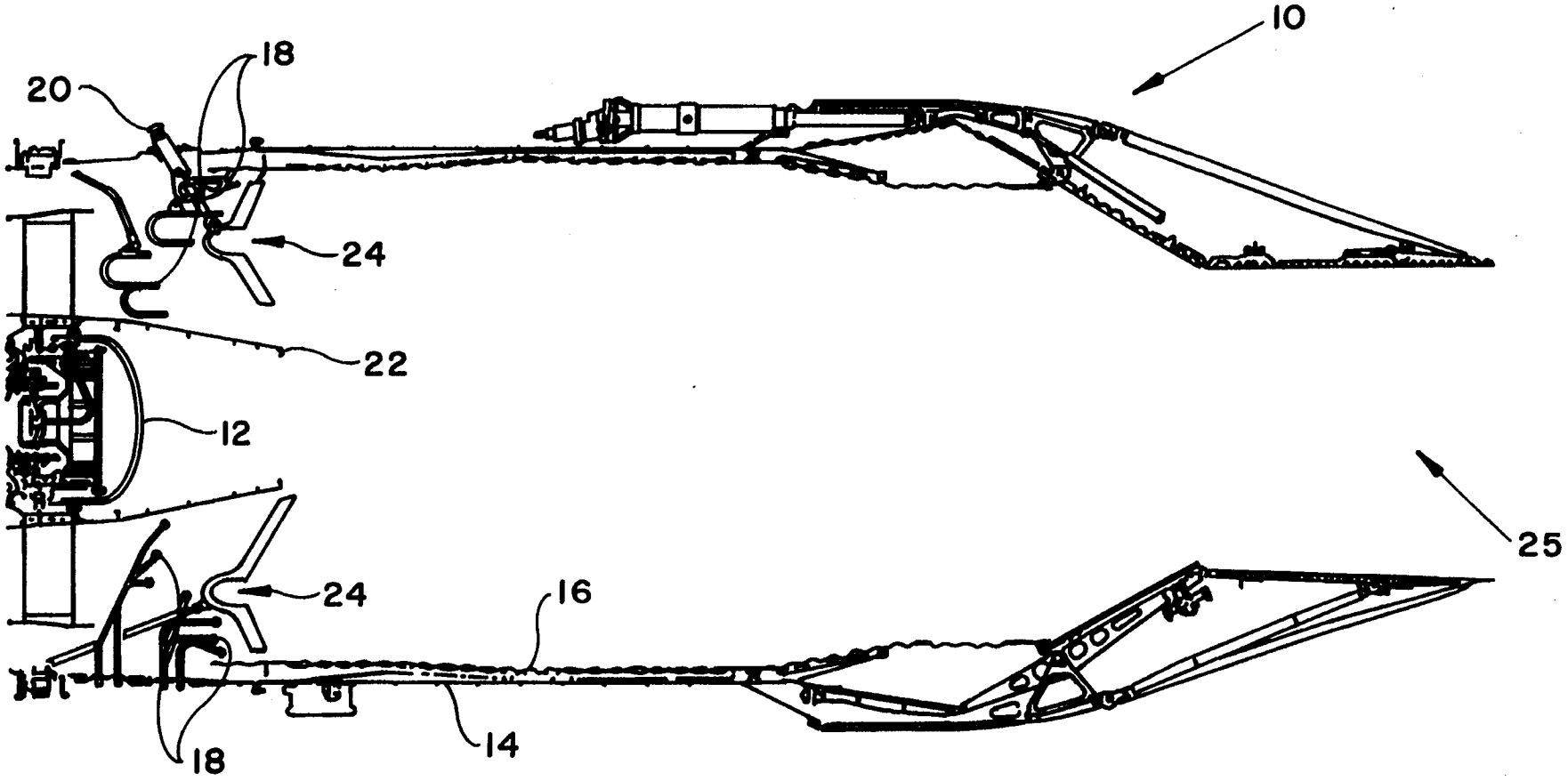
FIG. 1 (PRIOR ART)
FIG. 1 is a modified cross-sectional diagram of a thrust augmentor section of a high performance jet engine according to the prior art.
Figure 2:
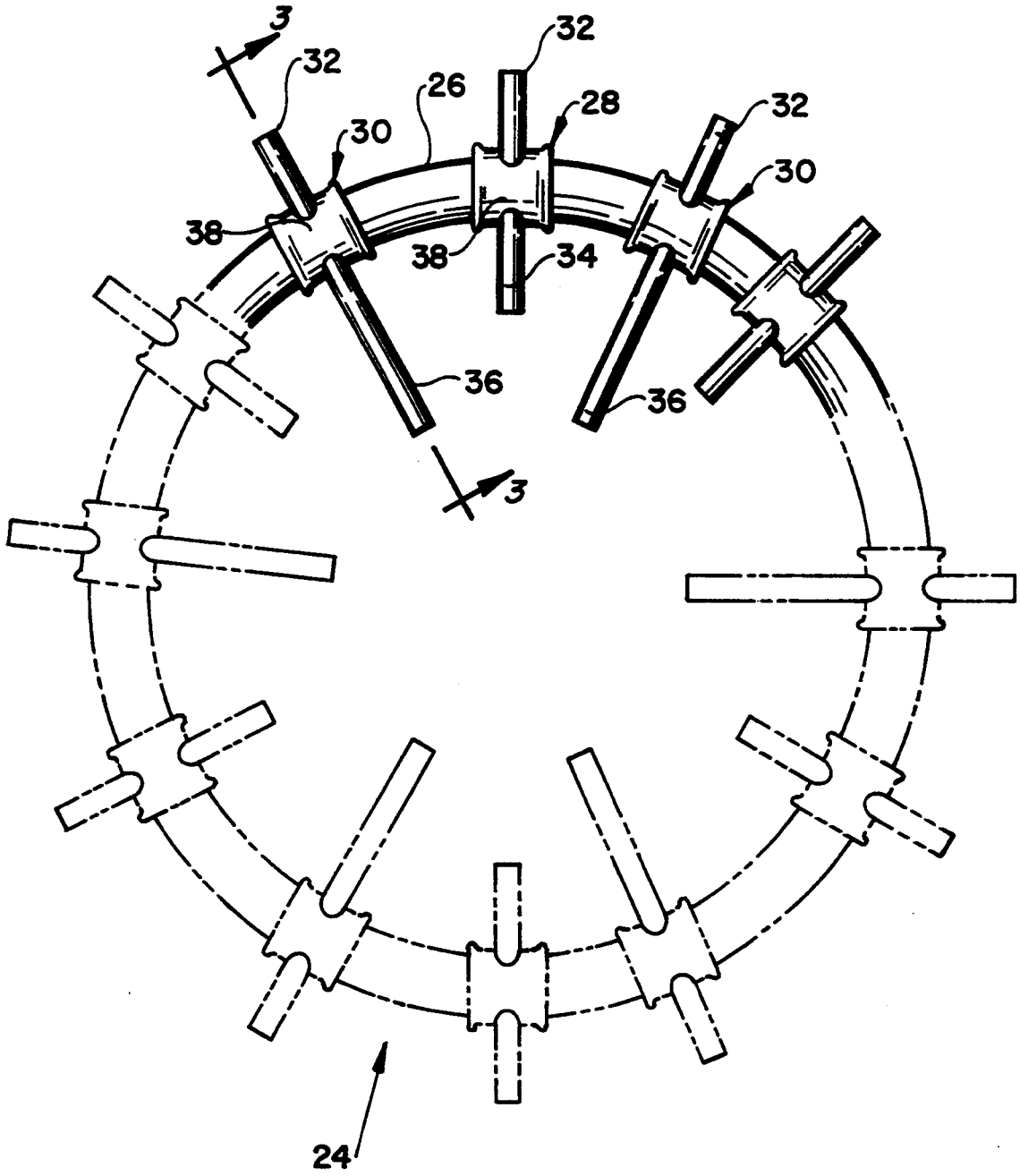
FIG. 2 (PRIOR ART)
FIG. 2 is an axial view of a prior art flameholder useful in the jet engine of FIG. 1.
Figure 3:
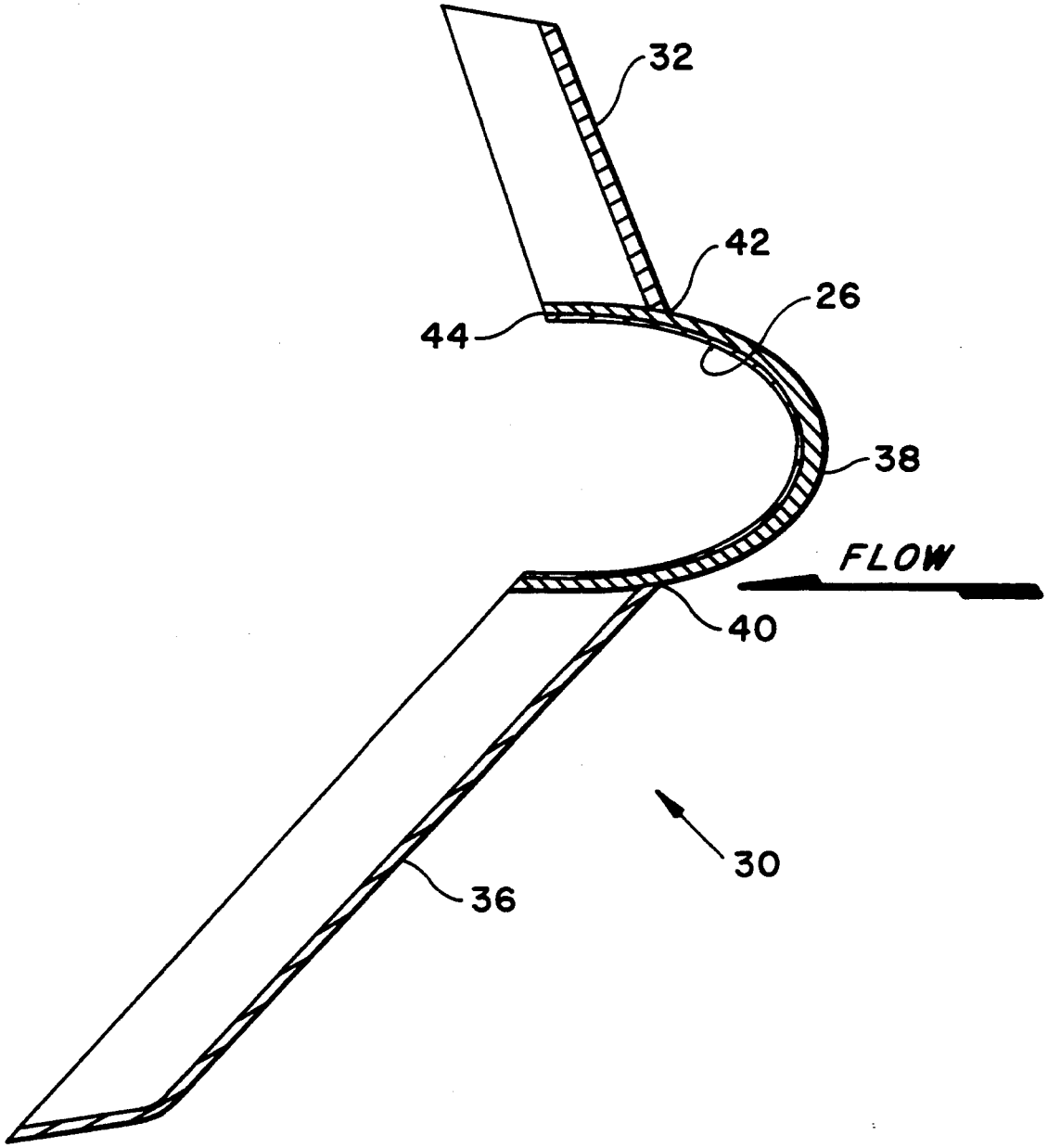
FIG. 3 (PRIOR ART)
FIG. 3 is a modified cross-sectional view of the FIG. 2 flameholder.

In flameholder 48, there is provided a pilot gutter 51, outer radial gutters 52 and inner radial gutters 50, 56, which are formed from a single piece of metal. This construction not only reduces fabrication cost, by eliminating the need for welding the radial gutter saddle sub-assemblies 28 and 30 of the prior art flameholder 24, as illustrated in FIGS. 2 and 3, but also provides the ability to have different numbers of inner and outer radial gutters, thereby providing for a more uniform mixing of fuel and combustion air. In particular, by using a larger number of outer radial gutters than inner radial gutters, twenty four in the illustrated embodiment, which are shorter than conventionally used, the number of mixing and recirculation zones in the fan flow stream of the augmentor combustion chamber can be increased without the increase in blockage pressure loss that would occur with twenty four long gutters, thereby achieving an increase on the order of 0.6 to 1.0% maximum thrust. In the prior art flameholder 24 as shown in FIG. 2, the number of inner and outer radial gutters was equal and twelve in number, due to the saddle mounting configuration used in construction, as shown in FIG. 3. Accordingly, the outer radial gutters were longer to provide necessary fuel mixing and thereby were closer to the augmentor liner 16 of FIG. 1. Accordingly, the augmentor liner 16 was subjected to the development of heat streaks in the area of propagation in the vicinity of the longer outer radial gutters, thereby decreasing liner service lifetime. The shorter outer radial gutters embodied in the present invention result in heat propagation reaching the liner structure further aft, where the cooling is more effective, thereby increasing liner service lifetime.

Another advantage provided by the one piece construction of the present invention is improved cooling of the combustion side of the flameholder. In the prior art structure, the flameholder is cooled by the engine stream air which approaches the radial gutter assembly from the left side as shown in FIG. 1. However, the welded construction of the prior art gutters creates discontinuities in the stress profile of the flameholder at the interface between the gutters and the welds, thereby providing a thermal barrier which reduces the air cooling of the combustion side of the flameholder. Saddle 38, which is rivetted to the pilot gutter 26 provides an additional thermal barrier which further reduces the air cooling of the combustion side of pilot gutter 26, thereby necessitating the use of a sprayed ceramic thermal barrier coating to prevent over-heating of the gutter interior in the region of the saddles. Elimination of the saddle construction eliminates the need for this thermal barrier.

Furthermore, conventional welded gutter construction results in stress risers and alloy depletion associated with welded joints. Fuel incidence on flameholders induces localized high stresses, especially in areas of thick welds in thin sheet metal joints operating at extremely high temperatures. The one piece construction with integral gutters eliminates the stress risers characteristic of prior art flameholders.

Furthermore, the present one piece integral construction permits design of flameholders with joints having rate changes in radius and thickness which are set to meet stress requirements of the particular metal used in the construction of the flameholder.

While there has been described what is believed to be the preferred embodiment of the present invention, those skilled in the art will recognize that other and further modifications may be made thereto without departing from the spirit of the invention, and it is intended to claim all such changes and modifications as fall within the true scope of the invention.

We claim:

1. In a gas turbine including a longitudinal axis an improved flameholder for a thrust augmentation combustor comprising a toroidal pilot gutter having a U-shaped cross-section and a plurality of inner and outer radial gutters having U-shaped cross-sections projecting from said pilot gutter, said pilot gutter and said radial gutters being formed integrally in a single piece of metal which is shaped to form said gutters and to form rounded corners at the intersections of said pilot gutter and said radial gutters, the axes of the radii of curvature of said rounded corners being parallel to said longitudinal axis of said gas turbine.

2. A flameholder as specified in claim 1, having selectable rate changes in radius and thickness, whereby the temperature induced stress profile of the flameholder is free from discontinuities.

3. A flameholder as specified in claim 2, wherein there are a greater number of said outer radial gutters than said inner radial gutters.

4. A flameholder as specified in claim 3, wherein said outer radial gutters are at equal angular spacing around said pilot gutter.

5. A flameholder as specified in claim 3, wherein said inner radial gutters are circumferentially spaced around said pilot gutter.

6. A flameholder as specified in claim 5, wherein said inner radial gutters comprise predetermined size inner radial gutters.

7. A flameholder as specified in claim 6, formed from sheet metal.

8. A flameholder as specified in claim 6, formed from a cast metal alloy.

9. An improved flameholder for a thrust augmentation combustor comprising a pilot gutter having a circular configuration about an axis, said pilot gutter having a U-shaped circumferential cross-section which is open in one axial direction, and a plurality of inner and outer radial gutters formed integrally with said pilot gutter out of a single piece of metal, said radial gutters having U-shaped cross sections and being open in said one axial direction, said radial gutters having rounded formed corners at their respective intersections with said pilot gutter, wherein said inner radial gutters comprise predetermined size inner radial gutters and said outer radial gutters are circumferentially spaced about said pilot gutter.

10. An improved flameholder as specified in claim 9, wherein there are a specified number of said inner radial gutters.

11. An improved flameholder as specified in claim 9, wherein there are a greater number of said outer radial gutters than inner radial gutters.

12. An improved flameholder as specified in claim 11, wherein there are twenty-four outer radial gutters and sixteen inner radial gutters.

* * * * *